United States Patent [19]

Steinlehner et al.

[11] 4,217,093

[45] Aug. 12, 1980

[54] FIXING ARRANGEMENT IN ELECTROSTATIC COPYING MACHINE

[75] Inventors: Fritz Steinlehner; Dieter Weidlich, both of Münich, Fed. Rep. of Germany

[73] Assignee: AGFA-Gevaert, A.G., Leverkusen, Fed. Rep. of Germany

[21] Appl. No.: 964,800

[22] Filed: Nov. 28, 1978

[30] Foreign Application Priority Data

Dec. 1, 1977 [DE] Fed. Rep. of Germany ..... 2753625

[51] Int. Cl.[2] ..... G03G 13/20

[52] U.S. Cl. ..... 432/59; 34/155; 219/216; 355/3 FU

[58] Field of Search ..... 432/8, 59, 60; 271/183, 271/194, 195; 406/86–88; 219/216; 355/3 FU; 34/92, 95, 155

[56] References Cited

U.S. PATENT DOCUMENTS

| | | | |
|---|---|---|---|
| 3,187,162 | 6/1965 | Hojo et al. | 219/216 |
| 3,296,958 | 1/1967 | Liepelt | 219/216 |
| 3,349,222 | 10/1967 | Johnston | 432/59 |
| 3,449,547 | 6/1969 | Goodman et al. | 219/216 |
| 3,478,665 | 11/1969 | Umahashi et al. | 219/216 |
| 3,517,164 | 6/1970 | Huggins et al. | 219/216 |
| 3,861,863 | 1/1975 | Kudsi | 432/59 |
| 3,914,097 | 10/1975 | Wurl | 432/59 |
| 3,980,863 | 9/1976 | Wulz et al. | 219/216 |

*Primary Examiner*—Henry C. Yuen
*Attorney, Agent, or Firm*—Michael J. Striker

[57] ABSTRACT

The fixing arrangement comprises a heated aluminum plate heating the lower face of a tone-image-bearing copy paper. The heated plate comprises two transverse ribs extending transverse to the copy-paper transport direction and, intermediate them, a sequence of transversely spaced longitudinal ribs, the transverse and longitudinal ribs intersecting to form individual recessed rectangular fields, each of which, when closed off from above by the copy paper, confines air heated by the heating plate to form a transversely extending zone of hot-air air cushions heating the lower face of the paper. Transversely extending suction channels located upstream and downstream of the hot-air air-cushion zone contain transversely extending rows of suction apertures, for holding the sheet down against the ribs and closing off the individual hot-air air cushions. At any given instant, the area of the sheet in direct physical contact with the heating plate is minimal, because the crests of the ribs are rounded off to establish virtually zero or line contact with the paper. The longitudinal ribs can be inclined relative to the transport direction, to prevent perceivable streaks in the final fused image.

16 Claims, 3 Drawing Figures

Fig. 1
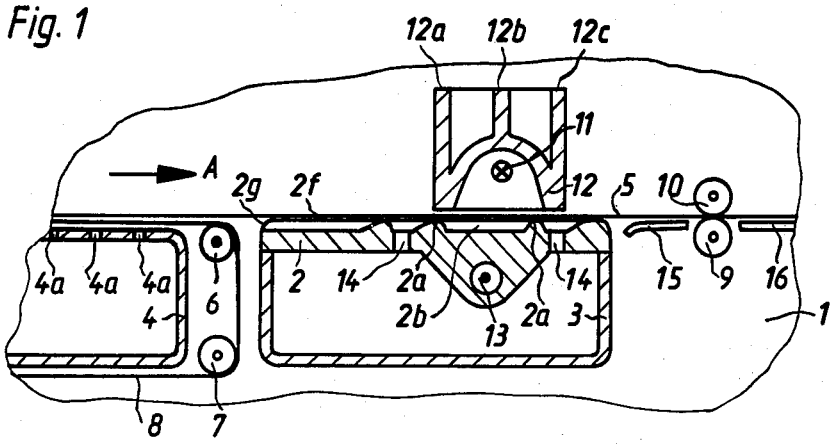
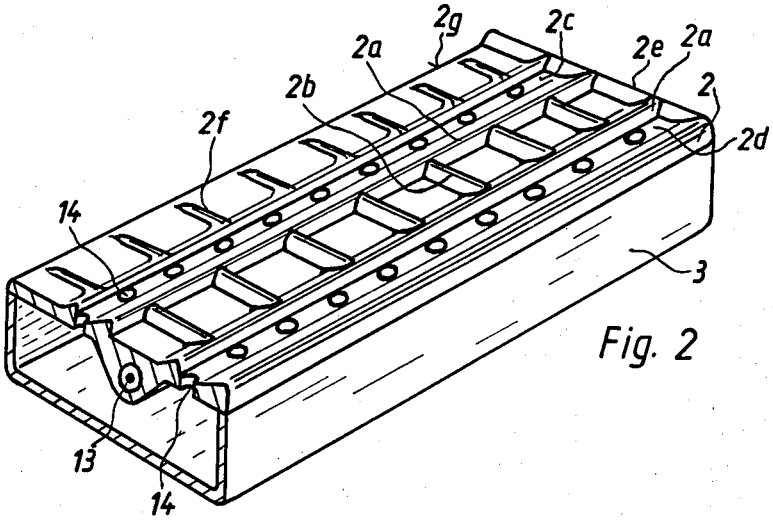
Fig. 2
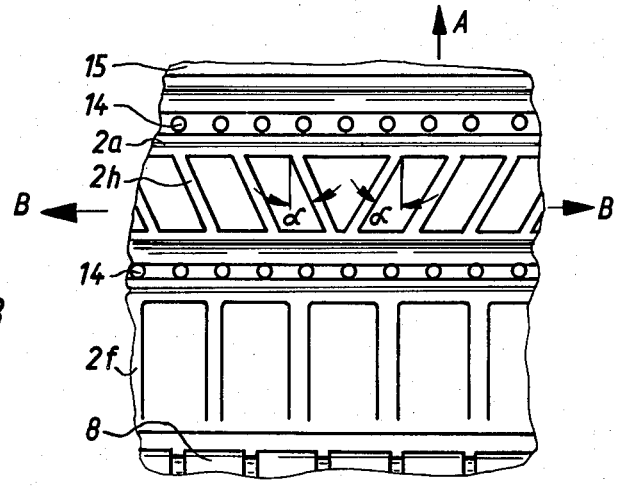
Fig. 3

FIXING ARRANGEMENT IN ELECTROSTATIC COPYING MACHINE

BACKGROUND OF THE INVENTION

The present invention concerns fixing arrangements for electrostatic copying machines, serving to fuse the toner image transferred onto the upper (i.e., toner-image-bearing) face of a copy paper from an intermediate image carrier, e.g., a rotating copying drum. Fixing arrangements of the type in question comprise a heated plate serving to warm the lower face of the copy paper (i.e., the face not bearing the toner image) and also transport means for transporting the toner-image-bearing copy paper, or other such copy stock, through the fixing arrangement.

With known fixing arrangements of this particular type—e.g., that disclosed in U.S. Pat. No. 3,187,162, but that one merely by way of example—it is in general attempted to assure sufficient heat-transferring surface contact between the lower face of the copy paper and the upper surface of the heating plate by, in particular, making the upper surface of the heating plate as perfectly smooth as possible.

However, it has been found that even this expedient can lead to non-uniforming heating action, when resort is had to various conventional techniques for pressing the copy paper against the heating plate. The result of non-uniform heating action is non-uniforming fixing or fusing of different portions of the toner image, some portions of the toner image being excessively fixed and others insufficiently fixed. This is visually perceivable in the final copy in a non-uniform quality or character of image.

SUMMARY OF THE INVENTION

It is the general object of the invention to take a different approach with fixing arrangements of the type in question, such as to assure considerably more uniform heating action resulting in final, i.e., fixed, images exhibiting high uniformity in their quality and character.

In accordance with the present invention, this is achieved by providing the upper surface of the heating plate with upwardly projecting projections serving to space the copy paper from the major part of the heating plate's upper surface, with these upward projections being shaped such as to minimize the fraction of direct surface contact between the lower face of the copy sheet, on the one hand, and the upper surface of the heating plate, on the other hand.

Utilizing the inventive fixing technique, the vast majority of the total surface area of the lower face of the copy sheet no longer directly contacts the heating plate, at any particular time, but instead is separated therefrom by a hot-air air cushion. This makes for an extremely uniform heating of the lower face of the copy paper, leading to a final image whose appearance exhibits an extremely high degree of uniformity of quality and character. Also, the extremely uniform heating action helps greatly to prevent warping of the copy paper as a result of the heating needed to effect toner-image fusing.

Preferably, the projections are in the form of elongated ribs, because these serve well to confine or create hot-air air cushions between them.

The establishment of hot-air cushions is made particularly effective if the projections on the upper surface of the heating plate comprise intersecting longitudinal and transverse ribs subdividing the space directly above the heating plate into individual hot-air air cushions each enclosed on all sides by intersecting ribs.

In accordance with a preferred concept of the invention, the upper surface of the heating plate is provided with suction apertures serving to hold the copy paper in contact with the projections or ribs. Advantageously, the heating plate is provided with transverse ribs extending transverse to the copy-paper transport direction across the full width of the heating plate, with these transverse ribs defining air-cushion zones, with these transverse ribs being preceded and followed by transversely extending suction channels, and with the suction channels containing suction apertures. The ribs or rib-like structures defining the transverse suction channels are preferably of sawtooth-shaped cross-sectional configuration, leaning in the direction of copy-paper transport. Preferably the suction force applied via the suction apertures is transmitted thereto by a suction conduit located beneath the heating plate, with the heating plate serving to close off the upper side of the suction conduit.

In this way, using very simple means, the copy paper is across its whole breadth very uniformly pressed against these ribs, with the suction action per se being confined to the region of the suction channels, i.e., so as not to interfere with the hot-air air cushions enclosed between adjoining ribs.

The individual hot-air air cushions can be enclosed by intersecting exactly longitudinal and transverse ribs, i.e., ribs respectively extending in the direction of copy-paper transport and in the direction perpendicular thereto. Then, however, the ribs laterally bounding the hot-air air cushions, i.e., in this instance the longitudinal ribs, would contact the bottom face of the transported copy paper along well-defined contact lines extending in the direction of copy-paper transport, with a resultant tendency for the final image on the copy paper to exhibit streaks or stripes extending in the direction in which the copy paper had been transported over the surface of such exactly longitudinal ribs.

Accordingly, the invention contemplates having those ribs which are to laterally bound the hot-air air cushions extend at an angle relative to the copy-paper transport direction. This prevents formations of the streaks in question, and incidentally or concomitantly serves to spread out across a greater fraction, or indeed all, of the copy-paper surface the heat transfer resulting from direct physical contact of the copy paper with the structure of the heating plate. If, additionally, these ribs have equal but opposite inclinations relative to the longitudinal centerline of the transported copy paper, so as to diverge in the direction of copy-paper transport, this can serve to transversely smooth out the transported sheet, i.e., flat to either side away from its longitudinal centerline, as it passes through the fixing arrangement.

In the presently preferred embodiment of the invention, the actual heating-up of the heating plate is performed by a heating element extending, transversely to the copy-paper transport direction, through the material of the heating plate, i.e., enclosed within the material of the heating plate, with the heating element being electrically heated and its temperature controlled by a thermostatic regulator. A heat radiator is located above the heating plate, in per se conventional manner, to radiate heat to the upper, or toner-image-bearing, face of the copy paper.

According to a further concept of the invention, the most upstream transverse rib is preceded (i.e., as considered in the transport direction) by transversely spaced longitudinal ribs which define with such first transverse rib individual zones which are bounded on only three sides by intersecting ribs, in particular not bounded transversely on both sides, but instead on only one side by the first transverse rib. This serves to establish, upstream of the fully bounded hot-air air cushions, a preheating zone. The longitudinal ribs of the preheating zone advantageously extend inclined to the copy-paper transport direction, for reasons already set forth.

Preferably, the means transporting the copy paper through the novel fixing system is a suction belt system.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawing.

BRIEF DESCRIPTION OF THE DRAWING

FIG. 1 is a section through an exemplary embodiment of the inventive fixing arrangement;

FIG. 2 is a perspective view of the heating plate of the fixing arrangement, and of the suction conduit whose upper side is closed off by the heating plate; and FIG. 3 depicts one particular organization of heating-plate ribs.

DESCRIPTION OF THE PREFERRED EMBODIMENTS

In FIG. 1 numeral 1 denotes part of the housing of an electrostatic copying machine. The fixing arrangement of the machine includes a heating plate 2 which closes off the upper side of a U-shaped suction conduit 3. A further suction conduit 4 is located upstream of heating plate 2, as considered in the direction of transport A of a toner-image-bearing copy sheet 5. The upper side of suction conduit 4 is provided with suction apertures 4*a*, and guide rollers 6, 7 entrain a set of transport belts 8 (see also FIG. 3), which travel around suction conduit 4. Suction conduit 4 and the belts 8 form a per se conventional suction belt transport system for the sheet 5 bearing the toner image to be fused. Sheet transport downstream of the heating plate 2 is taken over by a pair of transport rollers 9, 10 located in a gap between two sheet guidance members 15 and 16. A heat radiator 11 is located above the heating plate 2, for radiating heat to the upper or toner-image-bearing face of the copy sheet 5. Heat radiator 11 is in per se conventional manner provided with a reflector 12, preferably of elliptical cross-sectional configuration, and reflector 12 is provided with cooling fins 12*a*, 12*b*, 12*c*.

The material of heating plate 2, preferably aluminum, encloses an electrically energized heating element 13 which extends transverse to the transport direction A of copy paper 5, the heating element 13 being for example inserted into a transversely extending bore in heating plate 2. Heating element 13 is electrically energized by means of a (non-illustrated) thermostatic regulator. The thermostatic regulator maintains the heating plate 2 at a temperature of e.g., 100°–130° C. so long as the electrostatic copying machine provided with the illustrated fixing arrangement is in ready condition, i.e., awaiting a command to initiate copying.

As shown particularly clearly in FIG. 2, the upper surface of heating plate 2 is provided with two transverse ribs 2*a*, each extending across the full width of the heating plate. Heating plate 2 is furthermore provided with a plurality of transversely spaced longitudinal ribs 2*b* (seven shown in FIG. 2), which extend in the direction of copy-paper transport. The two transverse ribs 2*a*, and the set of longitudinal ribs 2*b* serve to establish a heating zone, located directly above heating element 13, and located directly below and substantially congruent with the effective area of heating means 11, 12, comprising a sequence of recessed rectangular fields (seven complete fields shown in FIG. 2, plus part of an eighth), each rectangular field defining a hot-air air cushion. The upper edges of the intersecting ribs 2*a*, 2*b* are rounded-off to reduce the zone of physical contact with the lower face of the transported sheet 5 down to virtually zero or line contact. At any given instant, the surface of the transported copy sheet 5 comes into contact virtually only with the hot air of the rectangular air cushions confined between intersecting ribs 2*a*, 2*b*, each individual hot-air air cushion being closed off from above by the lower face of copy sheet 5 itself. Thus, at any given instant, the sheet 5 is, in effect, contacted from below only by hot air. This makes for an extremely high degree of heating-action uniformity and protects the sheet, to an extreme extent, from the possibility of scorching, or the like.

The upstream transverse rib 2*a* is preceded by a transversely extending suction channel 2*c*, this rib 2*a* bounding the downstream end of channel 2*c*. The downstream transverse rib 2*a* is followed by a transversely extending suction channel 2*d*, this rib 2*a* bounding the upstream end of channel 2*d*. Heating plate 2 is provided with two rows of suction apertures 14, each suction-aperture row extending along the length of, and being located at the bottom of, a respective one of the two suction channels 2*c*, 2*d*. The interior of suction conduit 3 beneath heating plate 2 communicates with a (non-illustrated) source of suction. Each suction channel 2*c*, 2*d* is bounded at its either end by a respective longitudinally extending boundary rib 2*e*, only one shown in FIG. 2. Accordingly, an underpressure is established in each suction channel 2*c*, 2*d*, as soon as the transported sheet 5 closes off the suction channel from above. It is to be understood that the breadth of the heating plate 2 corresponds, at least approximately, to the breadth of the transported copy sheet.

Accordingly, as copy sheet 5 travels across the heating plate 2, it is sucked down into contact with transverse ribs 2*a* and longitudinal ribs 2*b* at hold-down locations located just upstream and just downstream of the rectangular fields containing the hot-air air cushions, assuring that the hot-air air cushions are in fact rather tightly closed off by the sheet itself, so that the heat radiating from heating plate 2 at these rectangular fields is confined to the air cushions contained in these rectangular fields, making for a very efficient hot-air heating action.

In the illustrated embodiment, heating plate 2 is provided with a preheating zone located upstream of the main heating zone, i.e., upstream of the hot-air air cushions and the radiator 11, 12. This preheating zone is provided only with longitudinal ribs 2*f*. On the one hand, these longitudinal ribs 2*f* prevent extensive surface contact between the sheet and the major surface of heating plate 2. Because the rectangular fields implied by these longitudinal ribs 2*f* are closed off on only three sides, a comparable hot-air air cushion action does not result. On the other hand, the fact that heating-plate edge 2*g* is not provided with a further transverse rib facilitates entry of the copy sheet 5 onto the heating plate. For similar reasons, the two transverse ribs immediately upstream and downstream, and indeed bounding, each suction channel 2*c*, 2*d* are sawtooth-shaped when viewed in cross-section and lean in the sheet-transport direction; i.e., each such transverse rib has a leading surface which forms a more acute angle with the lower face of sheet 5 than does the trailing surface thereof.

FIG. 3 depicts a modification of the rib arrangement shown in FIG. 2. In FIG. 2, the longitudinal ribs 2*b* extend exactly in the sheet-transport direction. In FIG. 3 use is instead made of longitudinal ribs 2*h* which extend at an angle alpha relative to the sheet-transport direction A. In particular, whereas all longitudinal ribs 2*h* extend at such angle alpha, those located to one side of the longitudinal centerline of heating plate 2 extend with a first inclination, and those located to the opposite side of the longitudinal centerline extend with the opposite inclination, the ribs 2*h* diverging from the longitudinal centerline as considered in the sheet-transport direction A. In contrast to the ribs 2*b* of FIG. 2, this assures that exactly longitudinally extending zones of the sheet 5 are not in uninterrupted contact with the longitudinal ribs 2*h* of FIG. 3, thereby preventing the development of image streaks extending in the sheet-transport direction. Additionally, the divergent organization of the ribs 2*h* to either side of the longitudinal center line has the result that, at the zones of line contact with the sheet 5, the sheet is spread laterally in the directions of arrows B away from its own longitudinal centerline, this serving to smooth out or flatten out the sheet.

It will be understood that each of the elements described above, or two or more together, may also find a useful application in other types of constructions differing from the types described above.

While the invention has been illustrated and described as embodied in a heating plate provided with projectings configured as straight ribs, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims.

1. In an electrostatic copying machine, a fixing arrangement serving to fix the toner image on copy paper, comprising, in combination, transport means for transporting copy paper bearing on one of its faces a toner image to be fixed along a predetermined path; and a heating structure located along said path and facing against the other face of the copy paper, said heating structure having a major surface juxtaposed with the copy paper, said major surface being generally flat and including a pair of upwardly projecting elongated ribs contacting the copy paper to achieve a minimal direct physical contact with the copy paper and provide a confined hot-air air volume within the area between said ribs and the other face of copy paper, said major surface is provided with transverse ribs extending at least mainly in the direction traverse to the direction of said elongated ribs to form individual recessed fields each bounded on all sides by said ribs and confining hot air volumes when closed off by the other face of copy-paper.

2. The fixing arrangement of claim 1, wherein said ribs are generally straight ribs.

3. The fixing arrangement of claim 1 wherein said elongated ribs are provided with crests rounded off at their contact with the copy-paper to further minimize physical contact between said ribs and copy paper.

4. The fixing arrangement of claim 1, wherein said elongated ribs extend at least mainly in a direction of copy-paper transport.

5. The fixing arrangement defined in claim 1, said major surface of the heating structure being provided with suction apertures for holding said other copy-paper face down against said contact portions of said spacing projections.

6. The fixing arrangement defined in claim 1, the recessed fields being organized to form a heating zone comprised of adjoining hot-air air cushions; the heating structure furthermore including transverse ribs located upstream and downstream of the heating zone to define a transversely extending suction channel upstream of the heating zone and another downstream thereof, said major surface of the heating structure being provided with transversely extending rows of suction apertures located in the suction channels for holding said other copy-paper face against said ribs.

7. The fixing arrangement defined in claim 6, the transversely extending suction channels extending along the entire breadth of the heating structure, the breadth of the heating structure being transverse to the copy-paper transport direction.

8. The fixing arrangement defined in claim 6, the transverse ribs defining the suction channel having, when viewed in cross-section, the configuration of sawteeth leaning in the direction of copy-paper transport.

9. The fixing arrangement defined in claim 6, furthermore including a suction conduit joined to and closed off by the heating structure.

10. The fixing arrangement defined in claim 5, furthermore including a suction conduit joined to and closed off by the heating structure.

11. The fixing arrangement defined in claim 1, said longitudinal ribs extending at an angle relative to the copy-paper transport direction.

12. The fixing arrangement defined in claim 11, those of the inclined longitudinal ribs located to one lateral side of the middle of the heating structure extending with one inclination relative to the copy-paper transport direction, those of the inclined longitudinal ribs located to the other lateral side of the middle of the heating structure extending with the opposite inclination, the inclined longitudinal ribs to both lateral sides of the middle of the heating structure diverging from each other as considered in the copy-paper transport direction.

13. The fixing arrangement defined in claim 1, the material of the heating structure enclosing an electrical heating element extending through the material of the heating structure transverse to the copy-paper transport direction.

14. The fixing arrangement defined in claim 1, furthermore including a heat radiator located opposite to the hot-air air cushions and operative for radiating heat to the toner-image-bearing face of the copy-paper.

15. The fixing arrangement defined in claim 1, the heating structure furthermore having a preheating zone upstream of the hot-air air cushions as considered in the direction of copy-paper transport, the heating structure at said preheating zone having spacing projections configured to facilitate entry of the copy paper onto the heating plate but not completely enclosing individual recessed fields and therefore not forming such hot-air air cushions.

16. The fixing arrangement defined in claim 1, the transport means comprising suction belt transport means.

* * * * *